US008371686B2

(12) United States Patent
Yokouchi

(10) Patent No.: US 8,371,686 B2
(45) Date of Patent: Feb. 12, 2013

(54) LIQUID EJECTING APPARATUS

(75) Inventor: Hideya Yokouchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/208,227

(22) Filed: Aug. 11, 2011

(65) Prior Publication Data

US 2012/0038721 A1 Feb. 16, 2012

(30) Foreign Application Priority Data

Aug. 12, 2010 (JP) ..... 2010-181088

(51) Int. Cl.
*B41J 2/175* (2006.01)
*B41J 2/19* (2006.01)

(52) U.S. Cl. ..... 347/93; 347/92

(58) Field of Classification Search ..... 347/92, 347/93, 84, 85, 87, 89, 35, 36
See application file for complete search history.

(56) References Cited

U.S. PATENT DOCUMENTS

| | | | | |
|---|---|---|---|---|
| 7,093,930 | B2 * | 8/2006 | Yildirim et al. | 347/92 |
| 7,111,932 | B2 * | 9/2006 | Steed et al. | 347/92 |
| 7,192,132 | B2 * | 3/2007 | Suzuki | 347/94 |
| 7,537,328 | B2 * | 5/2009 | Okubo | 347/93 |
| 2010/0053284 | A1 | 3/2010 | Miyajima | |

FOREIGN PATENT DOCUMENTS

| | | |
|---|---|---|
| JP | 09-277552 | 10/1997 |
| JP | 2010-052210 | 3/2010 |

* cited by examiner

*Primary Examiner* — Kristal Feggins
(74) *Attorney, Agent, or Firm* — Workman Nydegger

(57) ABSTRACT

A liquid ejecting apparatus in which a pressure adjustment unit having a pressure adjustment valve is provided between a filter chamber that houses a filter and a recording head having nozzles through which ink is ejected, the opening size of filter hole is set to ½ of a minimum inner diameter Da of the nozzle of the recording head or lower, and a pressure for pumping ink with an air pump is adjusted to a value that permits air bubbles in the upstream side space to pass through the filter.

4 Claims, 7 Drawing Sheets

LIQUID EJECTING APPARATUS

The entire disclosure of Japanese Patent Application No: 2010-181088, filed Aug. 12, 2010 are expressly incorporated by reference herein.

BACKGROUND

1. Technical Field

The present invention relates to liquid ejecting apparatuses such as an ink jet recording apparatus, and more specifically, liquid ejecting apparatuses having a filter that filters liquid to be supplied to a liquid ejecting head and a filter chamber that houses the filter.

2. Related Art

Typical example of liquid ejecting apparatuses having a liquid ejecting head capable of ejecting a liquid and configured to eject a variety of liquids from the liquid ejecting head include, for example, an image recording apparatus such as an ink jet printer that performs recording by ejecting ink droplets so as to cause the ink droplets to land on a landing target (recording medium) such as a recording sheet. Further, in recent years, such a liquid ejecting apparatus has been applied not only to image recording apparatuses but also to a variety of manufacturing apparatuses. For example, in display manufacturing apparatuses for manufacturing liquid crystal displays, plasma displays, organic EL (electroluminescence) displays, FEDs (field emission displays) or the like, a liquid ejecting apparatus is used to eject a variety of materials in a liquid form such as a coloring material and an electrode material toward a pixel forming region, an electrode forming region or the like.

For example, the above-mentioned ink jet printer is configured to cause ink contained in ink cartridges to be introduced into an ink jet recording head (hereinafter referred to as a recording head), which is a type of liquid ejecting head, and ejected through nozzles of the recording head. It is desirable that ink flow channels (liquid flow channels) extending in the recording head from positions where ink is introduced to the respective nozzles are filled solely with ink. However, air bubbles may be entrained in the ink flow channel during filling (initial filling) of ink into the recording head or exchange of the ink cartridge. Although various measures are taken in this type of printer to prevent the entrainment of air bubbles, it is difficult to completely prevent the entrainment. The air bubbles in the ink flow channel gradually increase in size. When some of the air bubbles which have excessively increased in size move with the ink flow toward a pressure chamber, the air bubbles may clog the ink flow channel or nozzle. This may cause so-called missing dots in which ink is not ejected from the nozzle.

In order to prevent such a problem caused by air bubbles, JP-A-2010-052210 discloses a configuration in which a filter that filters out air bubbles or foreign substances and a filter chamber that houses the filter are provided at a region upstream of the recording head such that the air bubbles are captured by the filter inside the filter chamber.

FIG. 8 schematically shows an ink supply path extending from an ink cartridge 76 to nozzles 73 of a recording head 75 in a printer of the related art. The ink within the ink cartridge 76 is pressurized by an air pump 77 and delivered to a pressure adjustment unit 74 through an ink supply tube 78. The ink which is introduced into the pressure adjustment unit 74 is then directed to pass through a first filter 79 arranged in a first filter chamber 80 and into a pressure adjustment section 84 having a pressure adjustment valve 83 where the ink is depressurized. The ink is further directed to pass through a second filter 81 arranged in a second filter chamber 82 and then supplied to the recording head 75. The pressure adjustment section 84 opens/closes a pressure adjustment valve 83 in accordance with the internal pressure so as to adjust the pressure of ink to be supplied to the recording head 75 at a constant pressure. This can prevent an excessive pressure rise that may cause poor ejection of ink even when the region upstream of the pressure adjustment section 84 is pressurized with a higher pressure than the region downstream of the pressure adjustment section 84.

In the configuration mentioned above, each of the first filter 79 and the second filter 81 are members for filtering ink which flows from the ink cartridge 76 and are formed of, for example, metal wires finely braided into a mesh. Each filter has a number of filter holes. The hole opening size of the second filter 81 which is disposed in the region downstream of the pressure adjustment section 84 is, for example, on the order of 20 μm in diameter so as to prevent air bubbles and foreign matter from being introduced into the recording head 75. The hole opening diameter of the second filter 81 is slightly smaller than the minimum opening diameter of the nozzle 73 (the opening diameter at the ejection surface). Further, the hole opening size of the first filter 79 which is disposed in the region upstream of the pressure adjustment section 84 is, for example, slightly larger than 20 μm in diameter so as to prevent air bubbles and foreign matter from being introduced into the pressure adjustment section 84.

Air bubbles entrained in the ink supplied from the ink cartridge 76 are captured in an upstream side space 85 which is located upstream of the first filter 79 within the first filter chamber 80. Further, air bubbles which have passed through the first filter 79 are captured in an upstream side space 86 within the second filter chamber 82. This enables air bubbles to be prevented from being introduced into the recording head 75 when ink is ejected at the velocity of ejection during a typical recording operation (printing operation) by the recording head 75. Since air bubbles captured in the upstream side space within the filter chamber may increase in size, a cleaning process has been performed to forcibly suction ink or air bubbles from the nozzles 73 by applying a negative pressure to the sealed space by means of a suction pump, which is not shown, with the nozzle surface of the recording head 75 being sealed with the cap member of the capping mechanism 87. This cleaning process enables air bubbles which are captured in the upstream side space within the filter chamber to pass through the filter and to be discharged through the nozzles 73. However, since the hole openings of the conventional filter have a diameter only slightly smaller than the minimum opening diameter of the nozzles 73 (the opening diameter at the ejection surface), air bubbles which have passed through the filter may grow to be larger than the minimum opening diameter of the nozzles 73. This may cause air bubbles to clog a nozzle, resulting in a problem of so-called missing dots in which ink is not properly ejected. In addition, the cleaning process has another problem in that an extra amount of ink is consumed.

The above-mentioned problems exist not only in ink jet recording apparatuses having a recording head that ejects ink, but also in other liquid ejecting apparatuses in which a filter chamber having a filter therein is provided partway along the liquid supply path.

SUMMARY

An advantage of some aspects of the invention is that a liquid ejecting apparatus capable of improving the discharge of air bubbles is provided.

According to an aspect of the invention, there is provided a liquid ejecting apparatus including a liquid ejecting head having nozzles through which liquid is ejected, a liquid containing member that contains liquid to be supplied to the liquid ejecting head, a pressurizing unit that pressurizes liquid contained in the liquid containing member and pumps the liquid to the liquid ejecting head through a liquid supply channel, a filter chamber provided upstream of the liquid ejecting head and having a filter that filters liquid supplied from the liquid containing member through the liquid supply channel and an upstream side space formed upstream of the filter, and a pressure adjustment unit provided between the filter chamber and the liquid ejecting head and having a pressure adjustment valve that depressurizes liquid from the filter chamber, wherein the filter has holes whose size is set to ½ of a minimum inner diameter of the nozzle or lower, a pressure from the pressurizing unit is adjusted to a value that permits air bubbles in the upstream side space to pass through the filter, and air bubble has a size smaller than the minimum inner diameter of the nozzle after passing through the filter and being depressurized by the pressure adjustment unit.

Accordingly, since the liquid ejecting apparatus has a configuration in which the pressure adjustment unit having the pressure adjustment valve is provided between the filter chamber and the liquid ejecting head, the opening size of the filter hole is set to ½ of the minimum inner diameter of the nozzle or lower, and the pressure for pumping liquid with the pressurizing unit is adjusted to the value that permits air bubbles in the upstream side space to pass through the filter, the air bubbles in the upstream side space are divided into smaller air bubbles when passing through the filter and the air bubble can be a size smaller than the minimum inner diameter of the nozzle even after depressurized in the pressure adjustment unit. Therefore, the air bubbles are discharged with ink from nozzles to the outside of the ink ejecting head without clogging the nozzles when ink is ejected through nozzles of the ink ejecting head. This makes it possible to prevent the air bubbles from being stagnated in the flow channel from the liquid containing member to the nozzles of the liquid ejecting head without a cleaning operation which has been performed in the related art. Since a cleaning operation is not needed, time and ink consumption for the cleaning operation can be saved.

In the above aspect of the invention, it is desirable that the hole size of the filter Df is defined according to the following formula (1):

$$Df \leqq Da/(Ra*Rb) \quad (1)$$

wherein Da is the minimum inner diameter of the nozzle, Ra is a ratio of the diameter of air bubble in the upstream side space when passing through the filter to the hole size of the filter, and Rb is a ratio between the diameters of air bubble before and after being depressurized by the pressure adjustment unit.

In the above aspect of the invention, it is desirable that the pressure from the pressurizing unit is set to a value where 15 kPa is added to a pressure loss from the liquid containing member to the filter or higher.

In the above aspect of the invention, the configuration can be possible in which the upstream side space is located on the lower side in the direction of gravity relative to the filter.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the accompanying drawings. Although the embodiments are specifically explained as preferred examples of the invention, the scope of the invention is not limited to those embodiments described herein except as specifically limited in the description. In the following description, an ink jet recording apparatus (hereinafter referred to as a printer) will be described as an example of the liquid ejecting apparatus of the invention.

Figure 1:
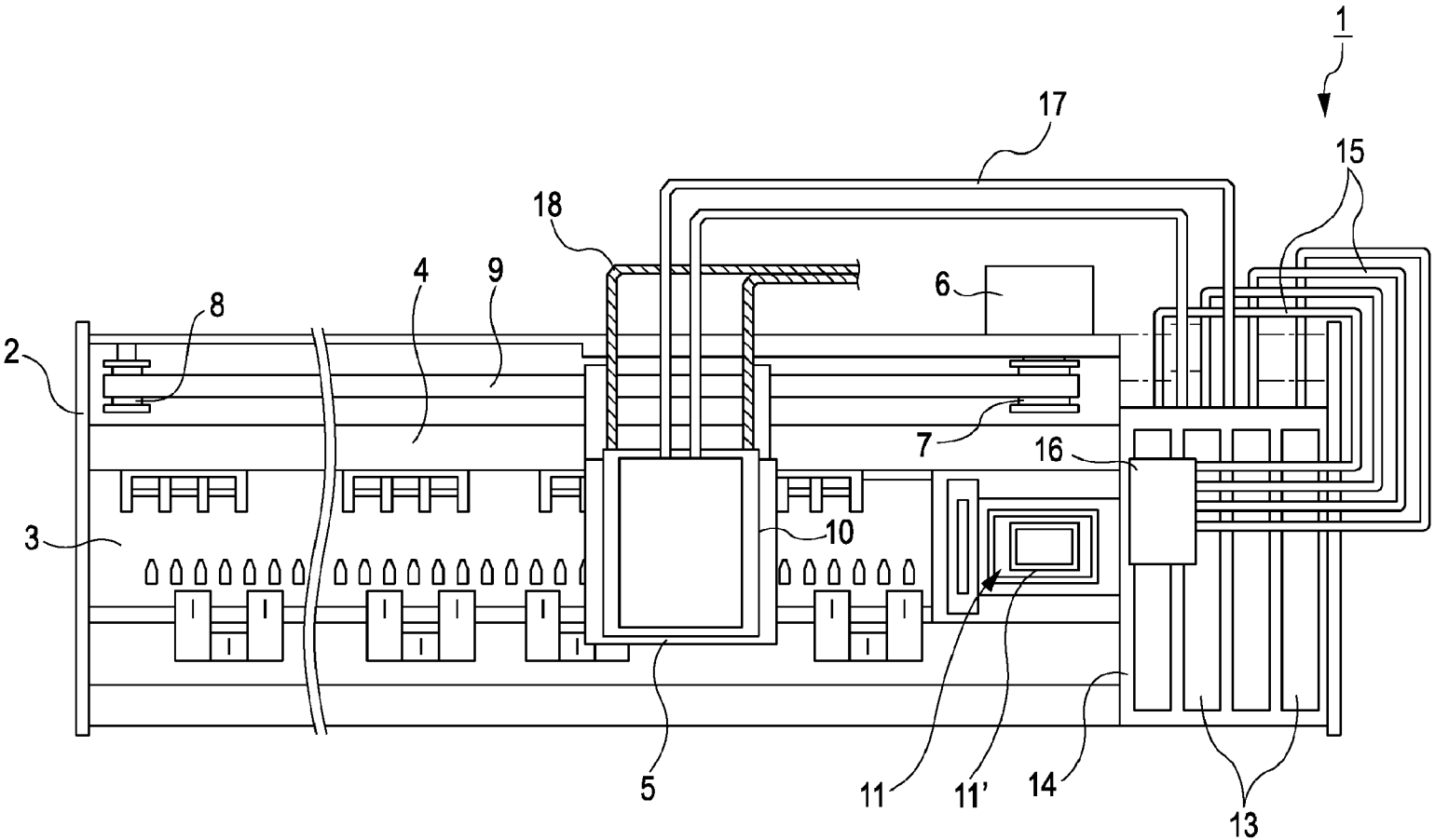
FIG. 1 is a plan view showing a configuration of a printer.
Figure 2:
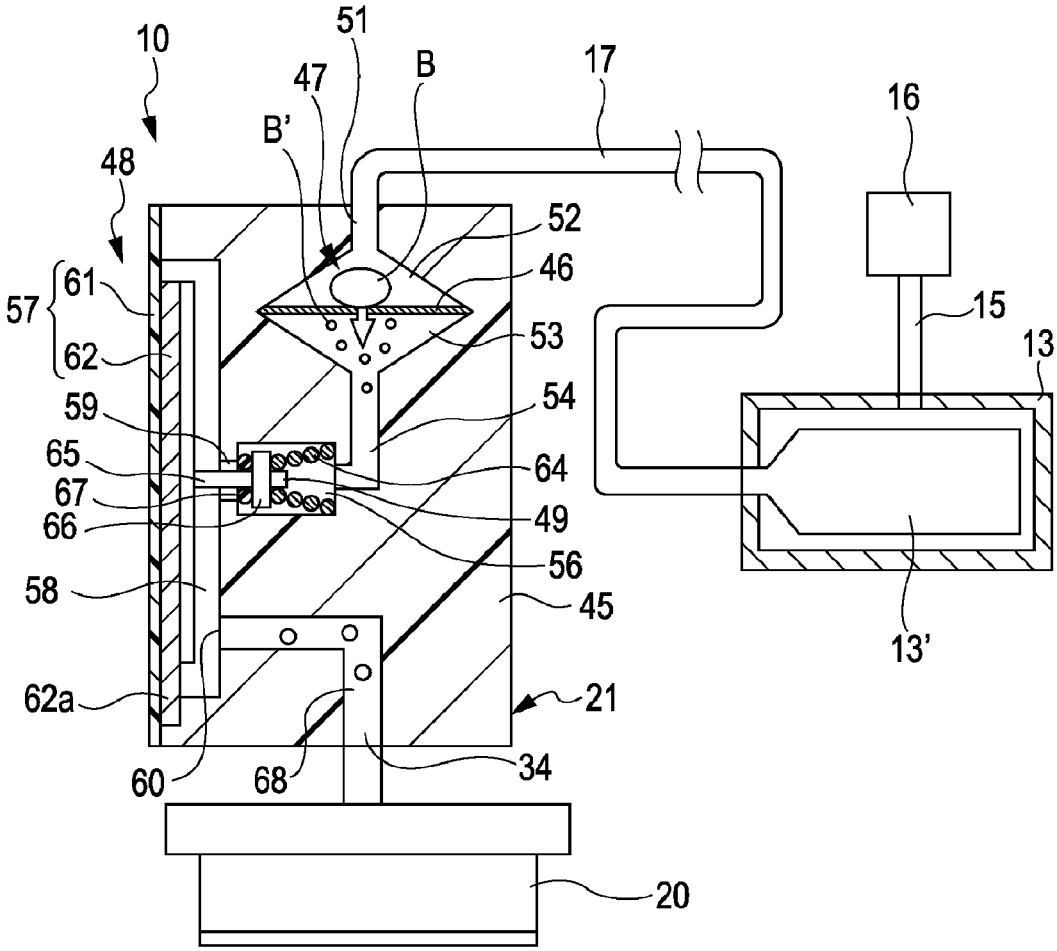
FIG. 2 is a schematic configuration view of an ink supply path extending from an ink cartridge to a recording head.

FIG. 1 is a plan view showing a configuration of a printer 1 in which an ink ejecting unit 10 (FIG. 2) is mounted. FIG. 2 is a schematic view showing a configuration of a path extending from an ink cartridge 13 to a recording head 20 via a pressure adjustment unit 21. The printer 1 according to this embodiment is an apparatus that performs recording of images or the like by ejecting ink in a liquid form (which corresponds to liquid of the invention) toward the surface of a recording medium such as a recording sheet (landing target), which is not shown. The printer 1 includes a frame 2 and a platen 3 that is arranged in the frame 2 and is configured such that the recording sheet is transported onto the platen 3 by means of a feeding roller that rotates by driving of a feeding motor (neither of which are shown in the figure). A guide rod 4 is arranged in the frame 2 parallel to the platen 3 such that a carriage 5 is slidably supported by the guide rod 4. The carriage 5 houses the ink ejecting unit 10 which includes the recording head 20. Further, the carriage 5 is connected to a timing belt 9 which runs between a driving pulley 7 that rotates by driving of a pulse motor 6 and a free rotating pulley 8 that is disposed on the side opposite to the driving pulley 7 in the frame 2. When the pulse motor 6 is actuated, the carriage 5 reciprocates along the guide rod 4 in a main scan direction which is perpendicular to a feeding direction of the recording sheet.

A cartridge holder 14 is provided on one side of the frame 2 and the ink cartridges 13 (a type of liquid containing member of the invention) are removably housed therein. Each ink cartridge 13 is connected to an air pump 16 (a type of pressurizing unit of the invention) via an air tube 15 such that air from the air pump 16 is supplied to the respective ink cartridges 13. An ink pack 13' (FIG. 2) is disposed in each ink cartridge 13, and when the pressurized air from the air pump 16 is supplied to apply a pressure to the ink pack 13', the ink in the ink pack 13' is urged (pumped) and caused to flow into the ink ejecting unit 10 via an ink supply tube 17. The relationship between the pressure from the air pump 16 during pumping of ink and a filter 46 will be described later in detail.

The ink supply tube 17 is, for example, a flexible hollow member made of a synthetic resin. An ink flow channel is formed inside the ink supply tube 17 so as to correspond to each ink cartridge 13. Further, flexible flat cables (FFC) 18 are arranged between the printer body 1 and the ink ejecting unit 10 so as to transmit drive signals and the like from a control unit (not shown) in the printer body 1 to the ink ejecting unit 10.

A capping mechanism 11 having a cap member 11' for sealing the nozzle surface of the recording head 20 is placed in a home position, which is provided at one end of the range of movement of the recording head 20 (which is closer to the cartridge holder 14). The cap member 11' is formed in a tray-like shape having an opening in the top surface and made of an elastic material such as an elastomer. The capping mechanism 11 is configured to seal the nozzle surface of the recording head 20 with the cap member 11' when the capping mechanism 11 is positioned at the home position in a stand-by state so as to prevent the solvent of ink from evaporating through the nozzles 37. Moreover, the capping mechanism 11 can apply a negative pressure to the sealed space in the recording head 20 by means of a suction pump, which is not shown, with the nozzle surface being sealed with the cap member 11' in order to perform a cleaning operation by forcibly suctioning ink or air bubbles from the nozzles 37.

Next, the configuration of the ink ejecting unit 10 is described. The ink ejecting unit 10 according to this embodiment includes the recording head 20 as a liquid ejecting head of the invention and a pressure adjustment unit 21 disposed upstream of the recording head 20. When a pressure is applied by means of the air pump 16, ink flows out of the ink cartridge 13 into the pressure adjustment unit 21 via the ink supply tube 17. The ink which is introduced into the pressure adjustment unit 21 is then directed to pass through a filter 46, which is described later, and into a pressure adjustment section 48 where the pressure is adjusted. Then, the ink is supplied to the recording head 20.

Figure 3:
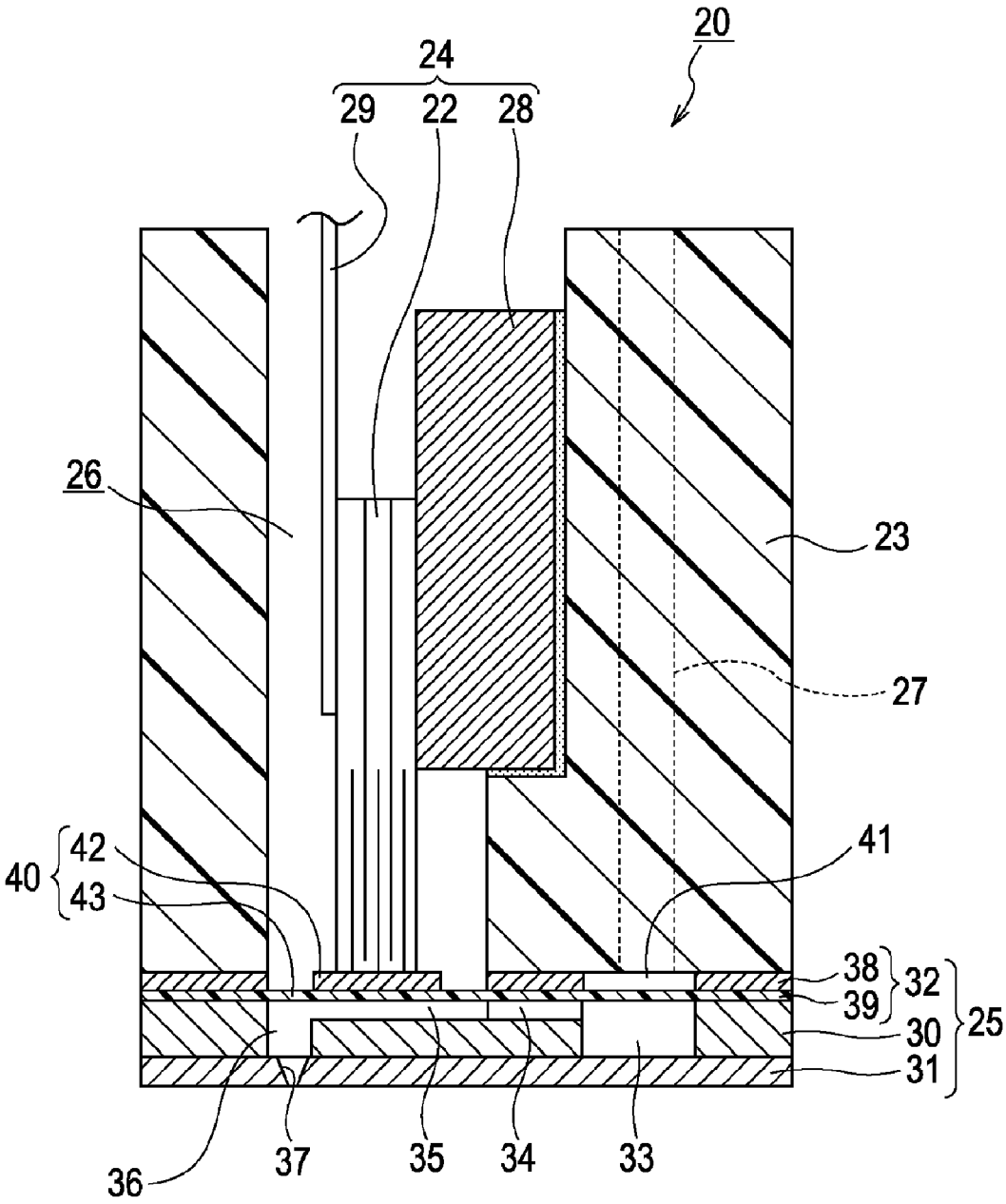
FIG. 3 is a sectional view of an essential portion of the recording head.

FIG. 3 is a sectional view of an essential portion of the recording head 20 for showing a configuration of the recording head 20. The recording head 20 according to this embodiment includes a case 23, a transducer unit 24 a flow channel unit 25 and the like. The case 23 has a housing space 26 therein to house the transducer unit 24. Further, an ink introduction flow channel 27 is formed in the transducer unit 24 such that one end of the ink introduction flow channel 27 communicates with an outlet channel 68 of the pressure adjustment unit 21, which is described later, and the other end communicates with a reservoir 33. Accordingly, the ink introduced from the outlet channel 68 of the pressure adjustment unit 21 is supplied to the reservoir 33 via the ink introduction flow channel 27.

The transducer unit 24 includes a piezoelectric transducer 22 which serves as a type of pressure generating unit, a fixation plate 28 to which the piezoelectric transducer 22 is secured and a flexible cable 29 that supplies drive signals to the piezoelectric transducer 22. The piezoelectric transducer 22 is of a layered-type composed of piezoelectric plates which are formed of piezoelectric layers and electrode layers alternatively arrayed and arranged in a comb tooth pattern. The piezoelectric transducer 22 is capable of expanding and contracting in the direction perpendicular to the layer direction (electric field direction) in a vertical vibration mode (electric field transverse effect type).

The flow channel unit 25 is composed of a flow channel forming substrate 30, a nozzle plate 31 which is bonded to one side of the flow channel forming substrate 30 and a vibration plate 32 which is bonded to the other side of the flow channel forming substrate 30. A reservoir 33 (a type of common liquid chamber and also referred to as a manifold), an ink supply port 34 (a type of liquid supply port), a pressure chamber 35, a nozzle communication port 36 and a nozzle 37 are provided in the flow channel unit 25. A series of ink flow channels, each extending from the ink supply port 34 to the nozzle 37 via the pressure chamber 35 and the nozzle communication port 36, are formed so as to correspond to the respective nozzles 37.

The nozzle plate 31 is a plate member form of, for example, a stainless steel in this embodiment, and has a plurality of nozzles 37 formed in rows arranged at a pitch in accordance with the dot formation density (for example, 180 dpi). A plurality of nozzle rows (nozzle groups) formed of arrays of nozzles 37 are formed on the nozzle plate 31 and each nozzle row is composed of, for example, 180 nozzles 37.

Figure 4:
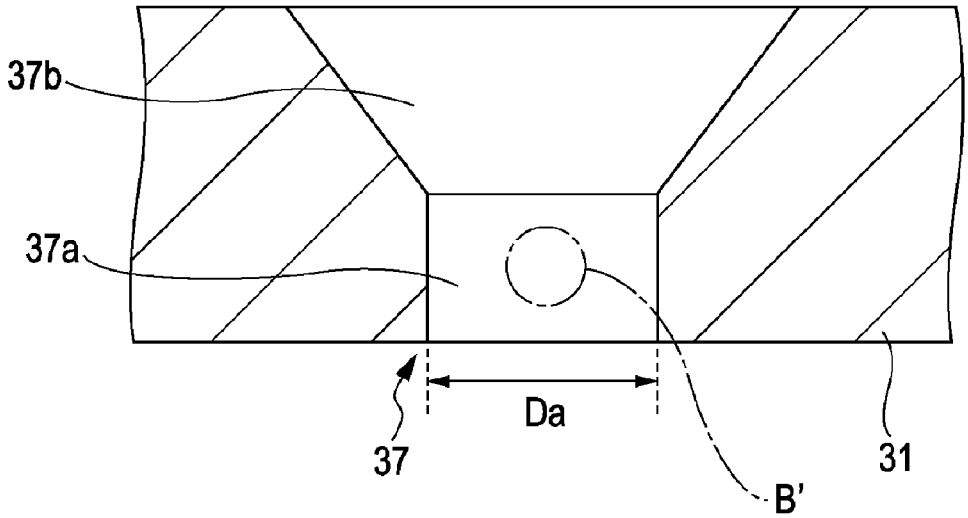
FIG. 4 is a sectional view of a nozzle taken along the nozzle axis for showing a configuration of the nozzle.

FIG. 4 is a sectional view of the nozzle 37 taken along the nozzle axis for showing a configuration of the nozzle 37. In the figure, the upper side of nozzle 37 faces the pressure chamber 35 and the lower side of nozzle 37 has the ink ejection surface (which faces the recording medium during recording). The nozzle 37 is formed of a straight section 37*a* and a tapered section 37*b*. The straight section 37*a* is a cylindrical space having a constant inner diameter Da (which corresponds to a minimum inner diameter of the invention). One end the straight section 37*a* (hereinafter referred to as an ejection side) is open to the ejection surface of the nozzle plate 31 and the other end (hereinafter referred to as a pressure chamber side) communicates with the tapered section 37*b*. The minimum inner diameter Da of the nozzle 37 according to this embodiment is, for example, 22 μm. The tapered section 37*b* is a space having one end that communicates with the straight section 37*a* and the other end that is open toward the pressure chamber side of the nozzle plate 31. The inner diameter of the tapered section 37*b* is formed to increase from the side facing the straight section 37*a* to the pressure chamber side.

The vibration plate 32 is formed of a double layered structure composed of a support plate 38 and a flexible elastic film 39 which is bonded to the surface of the support plate 38. In this embodiment, the vibration plate 32 is formed of a laminated composite plate composed of the support plate 38 of a stainless plate and the elastic film 39 of a resin film which overlays the surface of the support plate 38. The vibration plate 32 has a diaphragm section 40 that varies the volume of the pressure chamber 35. Further, the vibration plate 32 is provided with a compliance section 41 that seals a part of the reservoir 33.

The diaphragm section 40 is formed by partially removing the support plate 38 through an etching process or the like. That is, the diaphragm section 40 is composed of an island 42 to which the distal end surface of the free end of the piezoelectric transducer 22 is joined and a thin-walled elastic portion 43 that surrounds the island 42. The compliance section 41 is formed by removing the portion of the support plate 38 which faces the opening of the reservoir 33 through an etching process or the like. The compliance section 41 serves as a damper that absorbs pressure variations of the liquid contained in the reservoir 33.

When the free end of the piezoelectric transducer 22 expands and/or contracts, the volume of the pressure chamber 35 is changed since the distal end surface of the piezoelectric transducer 22 is joined to the island 42. Then, the pressure of ink in the pressure chamber 35 also changes in accordance with the varied volume of the pressure chamber 35. The recording head 20 is configured to eject ink droplets through the nozzles 37 by means of the variation of the pressure.

Next, the configuration of the pressure adjustment unit 21 is described. As shown in FIG. 2, the pressure adjustment unit 21 according to this embodiment is substantially configured such that a filter chamber 47 that houses a filter 46 and a pressure adjustment section 48 (a type of pressure adjustment unit according to this invention) that houses a pressure adjustment valve 49 are disposed within a unit body 45 made of a synthetic resin.

The ink which is pumped from the ink cartridge 13 via the ink supply tube 17 is introduced into the pressure adjustment unit 21 through the introduction port 51 and flows into the filter chamber 47. The filter chamber 47 is a space formed by an enlarged portion of the flow channel in the pressure adjustment unit 21 and composed of an upstream side space 52 and a downstream side space 53. The upstream side space 52 is a space having an inner diameter which gradually increases from the side of the introduction port 51 to the side of the downstream side space 53, while the downstream side space 53 is a space having an inner diameter which gradually decreases from the side of the upstream side space 52 to the side of a communication channel 54 that communicates with the pressure adjustment valve 49. The filter 46 is disposed at the interface between the spaces 52 and 53.

Figure 5:
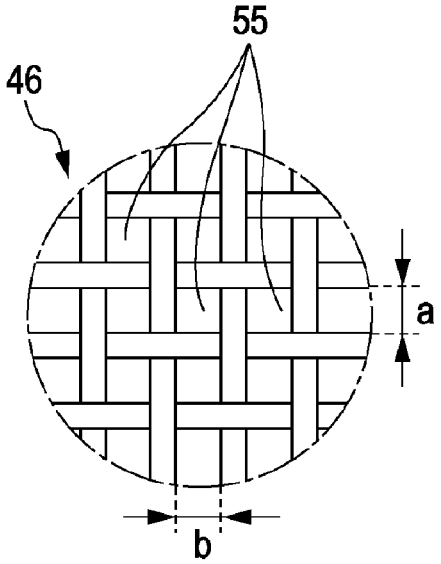
FIG. 5 is a plan view illustrating a portion of a filter in an enlarged manner.

FIG. 5 is a plan view illustrating a portion of the filter 46 in an enlarged manner. The filter 46 according to this embodiment is a member that filters ink from the ink cartridge 13 and is formed of, for example, metal wires finely braided into a mesh. As shown in FIG. 5, a number of filter holes 55 are formed over the entire surface of the filter 46. Although the filter hole 55 according to this embodiment is formed as a through hole of a rectangular shape as seen in a plan view, it may be formed as a through hole of a circular shape as seen in a plan view. The filter 46 filters out air bubbles B or foreign substances which are entrained in the ink from the ink cartridge 13 and are larger than the filter hole 55 and captures the air bubbles B or foreign substances in the upstream side space 52 so that they do not flow into the recording head 20. The opening size of the filter hole 55 (the hole size), which will be described in detail below, is formed to be sufficiently smaller than the minimum inner diameter Da of the nozzle 37 of the recording head 20. As a result, the air bubbles B' or foreign substances which have passed through the filter hole 55 of the filter 46 are discharged through the nozzle 37 together with ink. That is, the nozzle 37 is configured not to be clogged with the air bubbles B or foreign substances.

The filter chamber 47 communicates with the pressure adjustment section 48 via the communication channel 54. The ink which has passed through the filter 46 flows into an adjustment valve housing chamber 56 of the pressure adjustment section 48 through the communication channel 54. The pressure adjustment section 48 is substantially configured to include the adjustment valve housing chamber 56 that houses the pressure adjustment valve 49, the pressure adjustment chamber 58 that communicates with the adjustment valve housing chamber 56 and a pressure receiving member 57 that is placed so as to seal one side of the opening of the pressure adjustment chamber 58. The pressure adjustment chamber 58 is a space formed on a first side of the unit body 45 (left side in FIG. 2) as a recess having a rectangular shape which is recessed toward a second side of the unit body 45 (right side in FIG. 2). An inlet port 59 is formed in the bottom of the pressure adjustment chamber 58 substantially in the center in the vertical direction (a height direction of the unit body 45). The inlet port 59 communicates with the adjustment valve housing chamber 56. Further, an outlet port 60 is formed in the bottom of the pressure adjustment chamber 58 at a position downstream the inlet port 59.

The pressure receiving member 57 is composed of a flexible film member 61 that elastically deforms toward the inside of the pressure adjustment chamber 58 (toward the second side of the unit body 45) when the internal pressure of the pressure adjustment chamber 58 decreases to be lower than a predetermined value and an actuating piece 62 attached to the inner surface of the film member 61 (the side facing the pressure adjustment chamber). The film member 61 is made of, for example, a thin film of resin having flexibility. The film member 61 is bonded or adhered to the first side of the unit body 45 so as to seal the opening of the recessed portion which serves as the pressure adjustment chamber 58 (that is, one side of the opening of the pressure adjustment chamber 58). Accordingly, the film member 61 partially defines the pressure adjustment chamber 58. The actuating piece 62 is placed within the pressure adjustment chamber 58 with one end 62*a* being supported by the unit body 45 in a so-called cantilever manner. The actuating piece 62 is formed of, for example, a plate metal such as stainless steel.

The pressure adjustment valve 49 is configured to be switchable between an open valve state to permit ink to be introduced into the pressure adjustment chamber 58 and a closed valve state to block the ink flow into the pressure adjustment chamber 58. The pressure adjustment valve 49 is provided inside the adjustment valve housing chamber 56 which is formed upstream of the inlet port 59 while being biased toward the closed valve position with a bias member 64 formed of, for example, an irregular shaped coil spring. The pressure adjustment valve 49 includes a shaft 65 in a cylindrical shape, a flange 66 in a substantially disk-like shape which laterally extends from an outer periphery of the shaft 65 and a packing 67 placed on the top side of the flange 66 (the side facing the pressure adjustment chamber 58). The distal end of the shaft 65 (the distal portion relative to the flange 66) has an outer diameter which is slightly smaller than the inner diameter of the inlet port 59 and is inserted into the pressure adjustment chamber 58 through the inlet port 59. A gap is formed between the shaft 65 and the inner circumferential surface of the inlet port 59 such that ink from the filter chamber 47 is introduced into the pressure adjustment chamber 58 through the gap. The packing 67 is made of, for example, an elastic member such as an elastomer and arranged in a ring-like shape. The shaft 65 is inserted through the center opening of the packing 67.

The bias member 64 abuts the flange 66 of the pressure adjustment valve 49 so as to bias the entire pressure adjustment valve 49 toward the pressure adjustment chamber 58 and holds the closed valve state until the pressure adjustment chamber 58 is depressurized to a predetermined pressure. That is, the pressure adjustment valve 49 remains in the closed valve state in which the packing 67 is closely in contact with the periphery of the opening of the inlet port 59 unless a force is applied to the pressure adjustment valve 49 against the elastic force of the bias member 64. In the closed valve position, the pressure adjustment valve 49 blocks the ink flow from the adjustment valve housing chamber 56 to the pressure adjustment chamber 58.

When the pressure adjustment valve 49 blocks the ink flow into the pressure adjustment chamber 58, the internal pressure of the pressure adjustment chamber 58 gradually decreases as ink is consumed in the recording head 20. When the internal pressure of the pressure adjustment chamber 58 decreases to a predetermined value, the pressure receiving member 57 elastically deforms toward the inside of the pressure adjustment chamber 58, thereby pressing the actuating piece 62 toward the bottom side (the side facing the pressure adjustment valve 49). A pressing force caused by the elastic deformation of the pressure receiving member 57 presses the actuating piece 62, thereby pressing the distal end of the shaft 65 of the pressure adjustment valve 49 in the closed valve position so as to move the pressure adjustment valve 49 toward the open valve position against the elastic force of the bias member 64. Consequently, the packing 67 moves away from the periphery of the opening of the inlet port 59, thereby causing the pressure adjustment valve 49 to be displaced to the position where the close contact state is released (open valve position). In the open valve position, ink is permitted to flow from the adjustment valve housing chamber 56 into the pressure adjustment chamber 58 via the inlet port 59. Ink which is introduced into the pressure adjustment chamber 58 flows via the outlet port 60 and the outlet channel 68 and is supplied to the ink flow channel of the recording head 20. As ink flows into the pressure adjustment chamber 58, the internal pressure of the pressure adjustment chamber 58 increases. When the internal pressure of the pressure adjustment chamber 58 increases, a film member 42 is displaced from the bottom side of the pressure adjustment chamber 58 (the side facing the pressure adjustment valve 49) toward the side of the opening. This causes the pressure adjustment valve 49 to be displaced to the closed valve position by means of the biasing force of the bias member 64 so as to block the inlet port 59, thereby blocking the ink flow into the pressure adjustment chamber 58.

As mentioned above, the pressure adjustment section 48 in the pressure adjustment unit 21 adjusts the pressure of ink to be supplied to the recording head 20 at a constant pressure by reciprocating between the closed valve position and the open valve position of the pressure adjustment valve 49. In the recording head 20 according to this embodiment, the withstanding pressure of the meniscus at the nozzle 37 is on the order of 4 kPa. When a positive pressure acts on ink at the nozzle 37, ink leaks out from the nozzle 37 even when the recording operation is not performed. Therefore, the pressure acting on the meniscus at the nozzle 37 is slightly negative. However, when the pressure acting on the meniscus becomes lower than −4 kPa, it is difficult to form the meniscus at the nozzle 37 and may cause a problem in ink ejection from the nozzle 37. Accordingly, in this embodiment, the pressure acting on the meniscus at the nozzle 37 (that is, the ink pressure downstream of the pressure adjustment section 48) is adjusted to be −1 kPa by the pressure adjustment section 48 so that the meniscus remains in a proper state (the state in which ink can be properly ejected from the nozzles 37 during the recording operation). As a result, even in the configuration as shown in this embodiment in which the region upstream of the pressure adjustment section 48 is pressurized with a higher pressure, it is possible to prevent an excessive pressure rise that may cause poor ejection of ink. That is, the pressure adjustment section 48 is configured to depressurize ink which flows from the ink cartridge 13 before supplying the ink to the recording head 20.

In the printer 1 according to the invention, the opening size of the filter hole 55 of the filter 46 is defined smaller than the opening size of the filter hole of the filter generally used for filtering ink in the conventional printer. Specifically, the opening size of the filter hole 55 is defined as ½ or less of the minimum inner diameter Da of the nozzle 37. With this size of the filter hole 55, air bubbles at the nozzle 37 after passing through the filter 46 in the pressure adjustment unit 21 each have a size which is smaller than the minimum inner diameter Da of the nozzle 37. In this embodiment, the minimum inner diameter Da of the nozzle 37 is 22 μm, while the opening size of the filter hole 55 is 8 μm.

In addition, when the filter hole 55 has a rectangular shape as seen in a plan view, the opening size is defined as an average of the length in a vertical direction a (up-down direction in FIG. 5) and the length in a traverse direction b (left-right direction in FIG. 5). In this embodiment, the aspect ratio of the filter hole 55 is 1 and the opening size is defined as a length of any one side. Further, when the filter hole 55 has a shape other than a circular shape as seen in a plan view, the opening size is defined as a diameter of the circular shape having the same surface area as that of the filter hole 55. The specific definition (calculation) of the filter hole 55 will described below.

In this embodiment, since the filter hole 55 of the filter 46 has a small opening size and a large fluid resistance, a pressure loss for ink passing through the filter 46 is larger than that with the conventional filter. In order to supply ink from the pressure adjustment unit 21 to the recording head 20 without a problem, a pressure loss at the filter 46 is desirably 2 kPa or lower. The pressure loss ΔP (Pa) may be derived from the following formula (A). The formula (A) is for a filter hole having a circular shape in a plan view, and the formula (B) is for a filter hole having a rectangular shape in a plan view.

$$\Delta P=128*\eta*L/(\pi d4)*U \quad \text{(A)}$$

$$\Delta P=8*(a+b)2*\eta*L/(a3*b3)*U \quad \text{(B)}$$

wherein η is a viscosity of ink (Pa·s) at room temperature (for example, 25° C.), L is a length of the flow channel (m), d is a diameter of a circular hole (m), U is a volume velocity of ink in the flow channel (m3/sec), and a, b are lengths of the sides of a rectangular hole (m).

For example, when the opening size of the filter used for filtering ink in a printer of the related art is 20 μm and a pressure loss at the filter is 0.7 kPa, a pressure loss at the filter 46 having the opening size of 8 μm becomes 27 kPa. Therefore, in the printer 1 of this invention, a pressure for pumping ink with the air pump 16 is adjusted to the value that permits air bubbles in the upstream side space 52 to pass through the filter 46. Specifically, the pressure is set to the value where 15 kPa is added to the pressure loss from the ink cartridge 13 to the filter 46 or higher. More specifically, the value is set to, for example, 30 kPa. This enables ink from the ink cartridge 13 to smoothly pass through the filter 46, thereby preventing an insufficient supply of ink to the recording head 20. Further, air bubbles can pass through the filter 46 in the upstream side space 52 without applying a pressure difference using another pressurizing unit (for example, a negative pressure pump of the capping mechanism 11).

Even when the size of air bubbles B in the upstream side space 52 is larger than the minimum inner diameter Da of the nozzle 37, air bubbles B are divided into smaller air bubbles B' by passing through the filter hole 55 of the filter 46. The air bubbles which have passed through the filter 46 has a size approximately 1.5 to 2 times larger than the opening size of the filter hole 55. The air bubbles which have passed through the filter 46 become larger when depressurized in the pressure adjustment unit 21. The ratio Rb between the air bubble sizes before and after passing through the pressure adjustment unit 21 is expressed as Rb=(102 kPa+30 kPa)/(102 kPa−1 kPa) =1.3, assuming the atmospheric pressure is 102 kPa. That is, after passing through the pressure adjustment unit 21, the air bubble size increases by 30%. Therefore the opening size of the filter hole 55 is designed taking consideration of this increase. Specifically, the opening size Df of the filter hole 55 is defined as the following formula (C):

$$Df \leqq Da/(Ra*Rb) \quad \text{(C)}$$

wherein Da is the minimum inner diameter of the nozzles 37, Ra is the ratio of the diameter of air bubble in the upstream side space 52 when passing through the filter 46 to the opening size of the filter hole 55, and Rb is the ratio between the diameters of air bubble before and after being depressurized by the pressure adjustment unit 21.

For example, assuming that Da=22 μm, Ra=1.5, and Rb=1.3, the opening size Df of the filter hole 55 is set to 11.3 (μm) or lower. Further, for example, assuming that Da=22 μm, Ra=2, and Rb=1.3, the opening size Df of the filter hole 55 is set to 8.5 (μm) or lower. As a result, if the minimum inner diameter of the nozzle 37 is set to ½ of Da or lower, desirably to ⅖ of Da or lower, the opening size Df of the filter hole 55 allows air bubble size to be smaller than the minimum inner diameter Da of the nozzle 37, after passing through the filter 46, and even after passing through the pressure adjustment unit 21.

As mentioned above, with the configuration in which the pressure adjustment unit 21 having the pressure adjustment valve 49 is provided between the filter chamber 47 and the recording head 20, the opening size of the filter hole 55 is set to ½ of the minimum inner diameter Da of the nozzle 37 or lower, and the pressure for pumping ink with the air pump 16 is adjusted to the value that permits air bubbles in the upstream side space 52 to pass through the filter 46, the air bubbles are discharged with ink from nozzles 37 to the outside of the recording head 20 without clogging the nozzles 37 when ink is ejected through nozzles 37 of the recording head 20, since the air bubbles in the upstream side space 52 are divided into smaller air bubbles when passing through the filter 46 and the air bubble has a size smaller than the minimum inner diameter Da of the nozzle 37 even after depressurized in the pressure adjustment unit 21. This makes it possible to prevent the air bubbles from being stagnated in the flow channel from the ink cartridge 13 to the nozzles 37 of the recording head 20 without a cleaning operation which has been performed in a printer of the related art. Since a cleaning operation is not needed, time and ink consumption for the cleaning operation can be saved.

In this embodiment, a filter (filter chamber) other than the filter chamber 47 is not provided downstream of the pressure adjustment section 48. With this configuration, the distance between the filter 46 to the nozzle 37 of the recording head 20 can be reduced as possible. As a result, it is possible to prevent the fine air bubbles which have been divided when passing through the filter 46 from combining each other and growing into larger air bubbles. That is, some of the fine air bubbles which have been divided when passing through the filter 46 dissolve in ink as time elapses. In this embodiment, since the opening size of the filter hole 55 is relatively small, the air bubbles can be divided into finer bubbles, thereby facilitating the air bubbles which have passed through the filter 46 to dissolve in ink and improving the discharge of air bubbles. Meanwhile, since the air bubbles suspended in ink without dissolving in ink have a tendency to combine each other and grow in size, it is desirable to position the filter 46 close to the nozzles 37 as possible.

Figure 6:
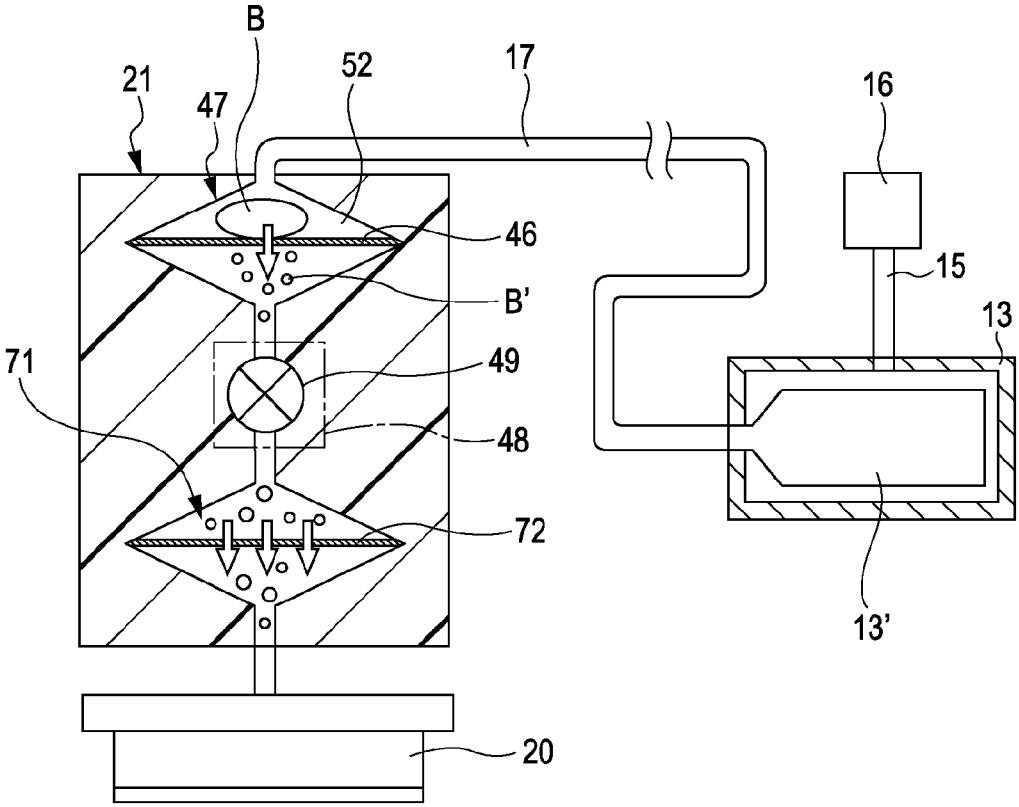
FIG. 6 is a schematic view showing a configuration according to a second embodiment.

FIG. 6 is a schematic view showing a configuration according to a second embodiment of the invention. In FIG. 6, the configuration of the pressure adjustment section 48 is omitted to be illustrated (the same applies to FIG. 7). Although the configuration has been shown in the first embodiment in which a filter (filter chamber) other than the filter chamber 47 is not provided downstream of the pressure adjustment section 48, the invention is not limited to this configuration. As shown in the second embodiment, the configuration in which a second filter chamber 71 housing a second filter 72 is provided downstream of the pressure adjustment section 48 may be possible. In the second embodiment, the opening size of the filter hole of the second filter 72 is sufficiently larger than the opening size of the filter hole 55 of the filter 46, and is for example, on the order of 20 μm. In the second embodiment, air bubbles B are also divided into smaller air bubbles at the filter 46 which is located upstream of the pressure adjustment section 48, the divided air bubbles B' can pass through the second filter 72 without stagnation. Therefore, in the second embodiment, it is also possible to prevent the air bubbles from being stagnated in the flow channel from the ink cartridge 13 to the nozzles 37 of the recording head 20 without performing a cleaning operation. The other configurations are the same as those in the first embodiment and therefore are not described.

Figure 7:
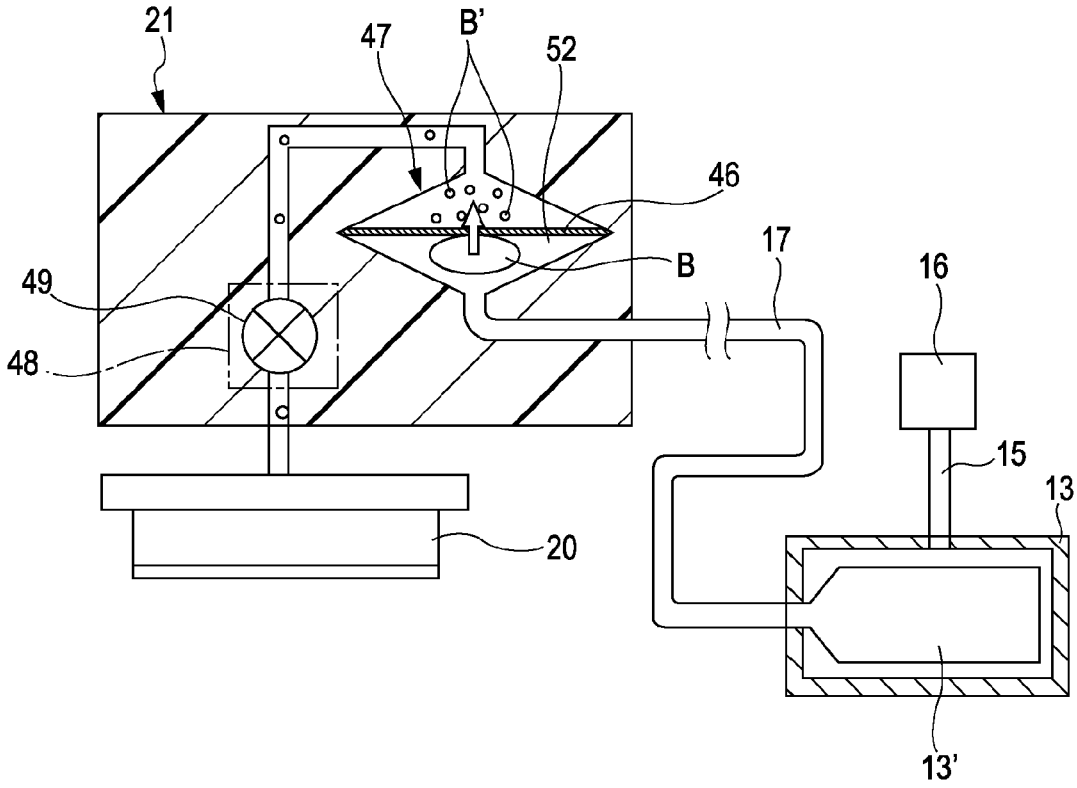
FIG. 7 is a schematic view showing a configuration according to a third embodiment.
Figure 8:
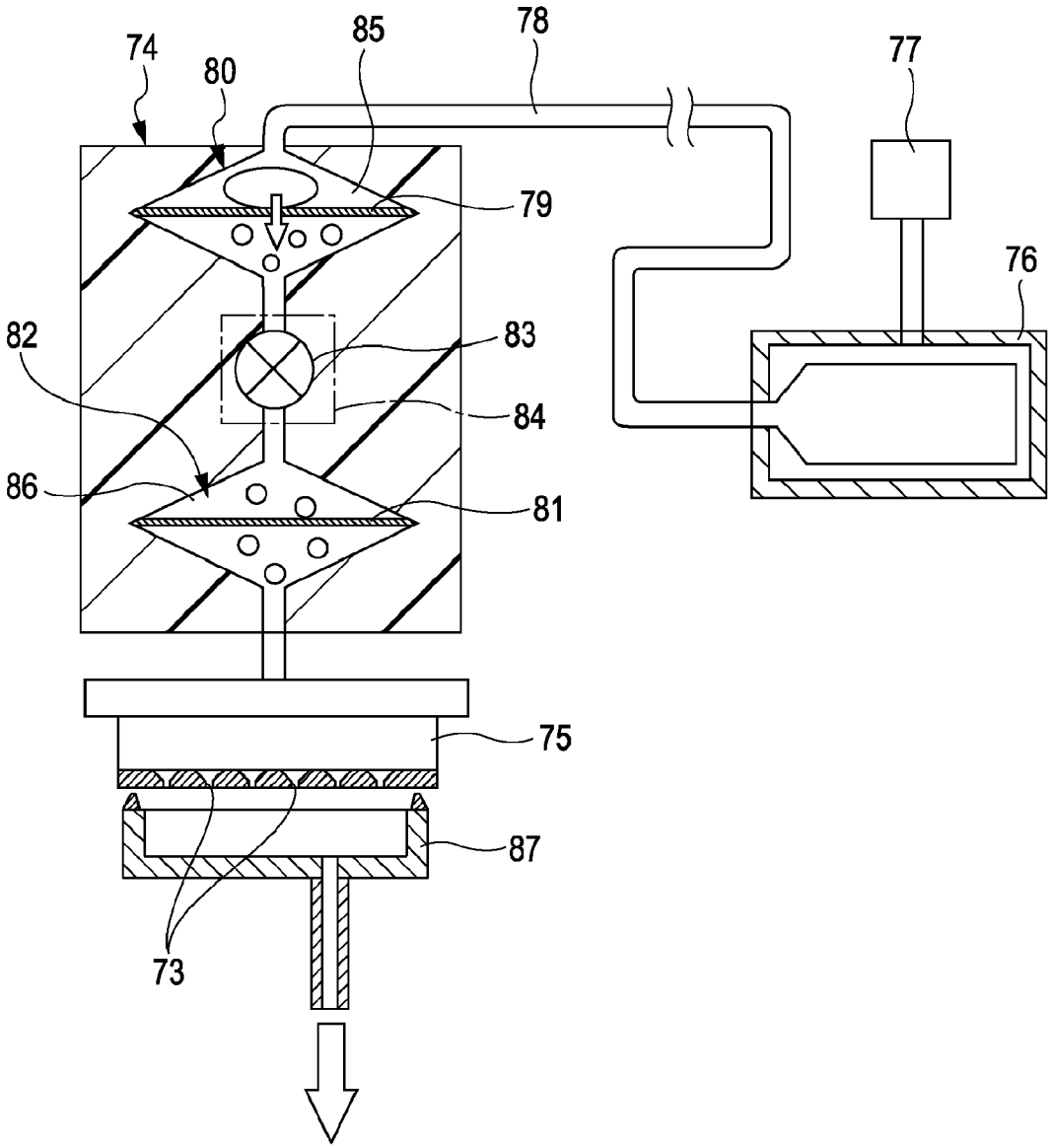
FIG. 8 is a schematic configuration view of a path extending from an ink cartridge to a recording head in a printer of the related art.

FIG. 7 is a schematic view showing a configuration according to a third embodiment of the invention. Although in the first and second embodiments, the upstream side space 52 has been described to be formed in the filter chamber 47 on the upper side in the direction of gravity relative to the filter 46, the invention is not limited to that configuration. In the third embodiment, the upstream side space 52 is formed in the filter chamber 47 on the lower side in the direction of gravity relative to the filter 46. With this configuration, the air bubbles B captured in the upstream side space 52 is pressed against the underside of the filter 46 due to the buoyancy force, and in addition to that, the buoyancy force facilitates the air bubbles B to pass through the filter 46. This can reduce the pressure from the air pump 16. As a result, it is possible to reduce the changes in size of the air bubbles between before and after the depressurization in the pressure adjustment chamber 58. Therefore, the opening size of the filter hole 55 can be formed larger than that in the first and second embodiments. The other configurations are the same as those in the first embodiment and therefore are not described.

Although the ink jet printer 1 has been described as an example of liquid ejecting apparatus, the invention can be applied to other liquid ejecting apparatuses having a filter chamber that houses a filter for filtering liquid, including, for example, display manufacturing apparatuses for manufacturing color filters of liquid crystal displays, electrode manufacturing apparatuses for manufacturing electrodes of organic EL (electroluminescence) displays, FEDs (field emission displays), chip manufacturing apparatuses for manufacturing biochips (biochemical chips), and micropipettes for accurately supplying an extremely small amount of sample solution.

What is claimed is:

1. A liquid ejecting apparatus comprising:

a liquid ejecting head having nozzles through which liquid is ejected;

a liquid containing member that contains liquid to be supplied to the liquid ejecting head;

a pressurizing unit that pressurizes liquid contained in the liquid containing member and pumps the liquid to the liquid ejecting head through a liquid supply channel;

a filter chamber provided upstream of the liquid ejecting head and having a filter that filters liquid supplied from the liquid containing member through the liquid supply channel and an upstream side space formed upstream of the filter; and a pressure adjustment unit provided between the filter chamber and the liquid ejecting head and having a pressure adjustment valve that depressurizes liquid from the filter chamber; wherein the filter has holes whose size is set to ½ of a minimum inner diameter of the nozzle or lower, a pressure from the pressurizing unit is adjusted to a value that permits air bubbles in the upstream side space to pass through the filter, and air bubbles have a size smaller than the minimum inner diameter of the nozzle after passing through the filter and being depressurized by the pressure adjustment unit.

2. The liquid ejecting apparatus according to claim 1, wherein the hole size of the filter Df is defined according to the formula (1):

$$Df \leqq Da/(Ra*Rb) \quad (1)$$

wherein Da is the minimum inner diameter of the nozzle, Ra is a ratio of the diameter of air bubble in the upstream side space when passing through the filter to the hole size of the filter, and Rb is a ratio between the diameters of air bubble before and after being depressurized by the pressure adjustment unit.

3. The liquid ejecting apparatus according to claim 1, the pressure from the pressurizing unit is set to a value where 15 kPa is added to a pressure loss from the liquid containing member to the filter or higher.

4. The liquid ejecting apparatus according to claim 1, wherein the upstream side space is located on the lower side in the direction of gravity relative to the filter.

* * * * *